United States Patent [19]

Zimmermann

[11] 3,954,254

[45] May 4, 1976

[54] METALLURGICAL FURNACE

[75] Inventor: Robert E. Zimmermann, Pittsburgh, Pa.

[73] Assignee: Koppers Company, Inc., Pittsburgh, Pa.

[22] Filed: Apr. 16, 1975

[21] Appl. No.: 568,618

[52] U.S. Cl. ..... 266/188; 266/192; 266/285

[51] Int. Cl.[2] ..... C21B 7/16

[58] Field of Search ..... 110/182.5; 122/6.6; 266/25, 29, 30, 32, 41

[56] References Cited

UNITED STATES PATENTS

| | | | |
|---|---|---|---|
| 386,269 | 7/1888 | Sahler | 266/30 |
| 445,381 | 1/1891 | Sahler | 266/30 |
| 468,306 | 2/1892 | Sahler | 266/30 |
| 1,763,248 | 6/1930 | Moore | 266/34 PP X |
| 2,339,192 | 1/1944 | Roberson | 266/25 |
| 3,148,973 | 9/1964 | Holowaty et al. | 266/29 X |
| 3,831,914 | 8/1974 | Zimmermann | 266/25 |

FOREIGN PATENTS OR APPLICATIONS

| | | | |
|---|---|---|---|
| 595 | 5/1886 | Sweden | 266/25 |

*Primary Examiner*—Gerald A. Dost

*Attorney, Agent, or Firm*—Sherman H. Barber; Olin E. Williams; Oscar B. Brumback

[57] ABSTRACT

A metallurgical furnace has an annular conduit or hot blast plenum encircling and formed as a part of the shell of the furnace, and such plenum has a variable venturi throat or passageway through which the wind or hot blast enters the furnace proper. The furnace shell above the plenum is supported by fluid-actuated cylinder-piston means connected to conventional shell supporting legs anchored to a fixed support.

13 Claims, 6 Drawing Figures

METALLURGICAL FURNACE

BACKGROUND OF THE INVENTION

The present invention relates to metallurgical furnaces and, more particularly, to blast and cupola-type furnaces used to produce molten iron.

In U.S. Pat. No. 3,831,914 I described a blast and/or cupola type of metallurgical furnace that includes a cylindrical shell divided into zones, with each zone being separately cooled. This furnace also includes a conventional bustle pipe and a plurality of tuyeres.

One of the operating problems experienced by owners of blast and cupola-type furnaces having tuyeres is water leaks and the necessity of removing and replacing tuyere blowpipe assemblies whenever such leaks occur.

In my continued effort to improve blast and cupola-type furnaces, I have conceived of such a type of furnace which does not experience loss of production time due to tuyere water leaks and due to the ever increasing difficulty in replacing tuyere-blowpipe assemblies. My improved blast and/or cupola type furnace has no conventional bustle pipe and no conventional tuyeres. Instead, my improved furnace has an annular wind or hot blast plenum which is formed integrally with, or which is connected securely to, the furnace shell. The wind or hot blast in the plenum enters the furnace through a narrow perimetrical slit in the encompassing shell or envelope as described more particularly hereinafter.

SUMMARY OF THE INVENTION

A metallurgical furnace for producing molten metal from ore comprises the improvement of a refractory lined envelope wherein there is a continuous perimetrical passageway and means for distributing blast air carried in a plenum around the perimeter of the envelope that flows through the passageway, with means for varying the cross-sectional area of the passageway.

For a further understanding of the invention and for features and advantages thereof, reference may be made to the following description and the drawing which illustrates a preferred embodiment of equipment in accordance with the invention.

DETAILED DESCRIPTION

Figure 1:
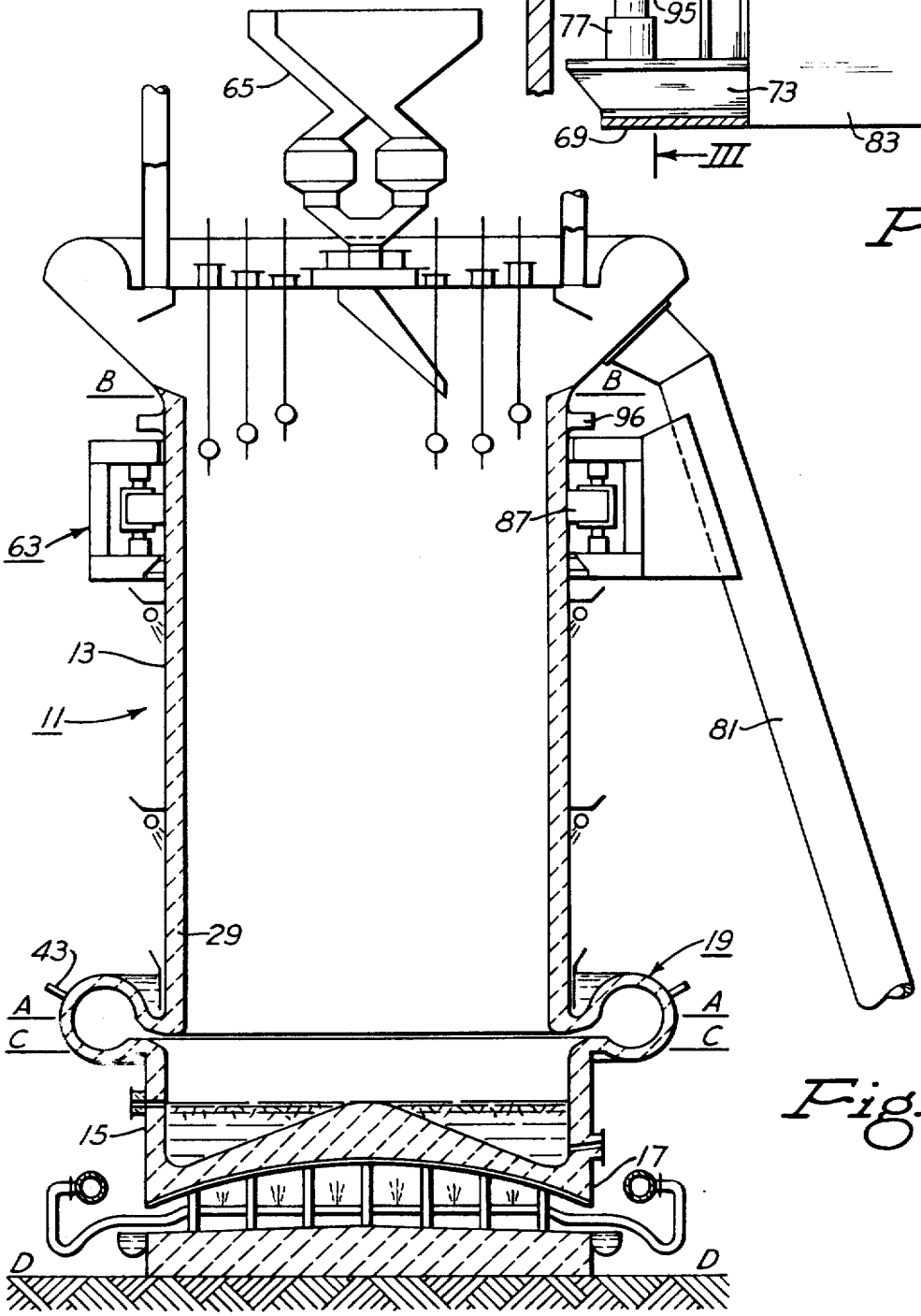
FIG. 1 is a schematic elevational sectional view of a metallurgical furnace incorporating an embodiment of my invention.

Referring to the drawings, FIG. 1 illustrates a form of metallurgical furnace 11 that is described generally, but not entirely specifically in U.S. Pat. No. 3,831,914. The furnace 11 has a generally cylindrical outer shell

13 of uniform diameter from a level A—A to an upper level B—B. From level C—C to level D—D, the furnace 11 also has a generally cylindrical shell 15 of uniform diameter that is somewhat greater than the diameter of the shell 13. The upper 13 and lower 15 shell portions are spaced apart as shown in FIG. 5 and as described hereinafter.

Since the hearth portion 17 of the furnace 11 is generally the same as that described in the aforementioned patent, it will not be described further here.

Figure 5:
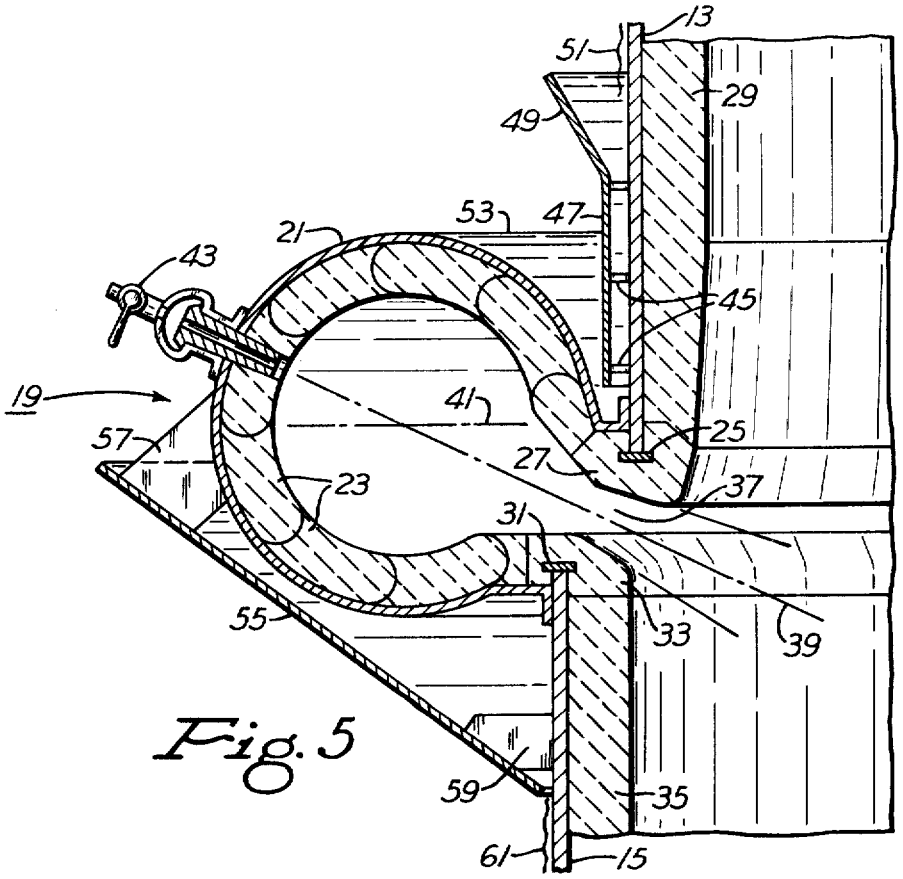
FIG. 5 is a vertical sectional view of another portion of the structure of FIG. 1 that incorporates an embodiment of a portion of my invention.

Between the levels A—A and C—C in FIG. 1 there is shown a novel form of variable perimetrical continuous tuyere belt or plenum 19 that is shown in detail in FIG. 5. The tuyere belt or plenum 19 surrounds the upper 13 and lower 15 shell portions which are spaced apart vertically as shown and which are of differing diameters; the diameter of the lower shell portion 15 being somewhat greater than the diameter of the upper shell portion 13.

The tuyere belt or plenum 19 is a generally toroidal-shaped conduit 21 that is secured both to the upper shell 13 and to the lower shell 15 in a suitable manner. The inner surface of the toroidal-shaped conduit 21 supports and is lined with a plurality of shaped refractory blocks 23, about as shown in FIG. 5. The lower edge of the upper shell 13 is fitted with non-continuous metal anchors 25 which are embedded in and hold an upper throat refractory shape 27 that abuts the refractory members 23 and also refractory lining 29 within the upper shell 13. In like manner, the upper edge of the lower shell 15 is fitted with non-continuous metal anchors 31 which are embedded in and hold a lower throat refractory shape 33 that abuts the refractory members 23 and also refractory lining 35 within the lower shell 15. The refractory shapes 27, 33 are so made that together they form a continuous perimetrical Venturi-type divergent throat or passageway 37 having an axis 39 that slopes angularly downward from the horizontal centerline plane 41 of the toroidal-shaped conduit 21.

Associated with the toroidal-shaped conduit 21 are peepsights 43 of conventional form that are installed at spaced-apart intervals in the conduit 21 about as shown.

The upper shell 13 supports, by means of lugs 45, an annular funnel-shaped cooling water-collecting arrangement 47 that surrounds the shell 13 in spaced-apart relation as shown. The arrangement 47 is provided at its upper end with a flared plate 49 which serves to better collect and hold cooling water 51 that flows down the outside of the shell as shown. The bottom of the arrangement 47 is open, and the cooling water 51 reaches a level 53 and flows over the top of the toroidal-shaped conduit 21.

A watershed annular plate 55 is supported away from the conduit 21 by means of spaced-apart brackets 57, and away from the lower shell 15 by means of other spaced-apart brackets 59. The watershed plate 55 itself is spaced apart from the shell 15 so that cooling water collected in the annular plate 55 flows down the lower shell, as suggested at 61.

The material comprising the refractory shapes 27, 33 may be zirconium oxide or any other suitable material that will be as resistant to wear and as durable in service as is possible.

Figure 2:
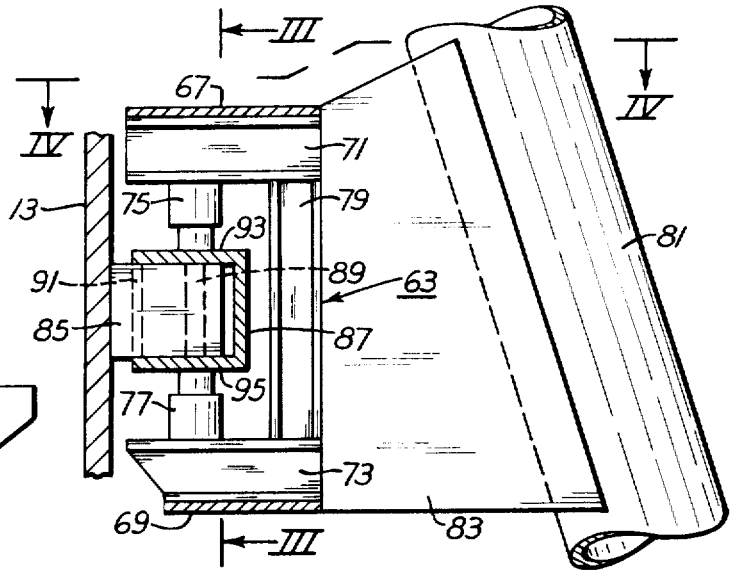
FIG. 2 is a vertical sectional view of a portion of the structure of FIG. 1 that incorporates an embodiment of a portion of my invention.
Figure 4:
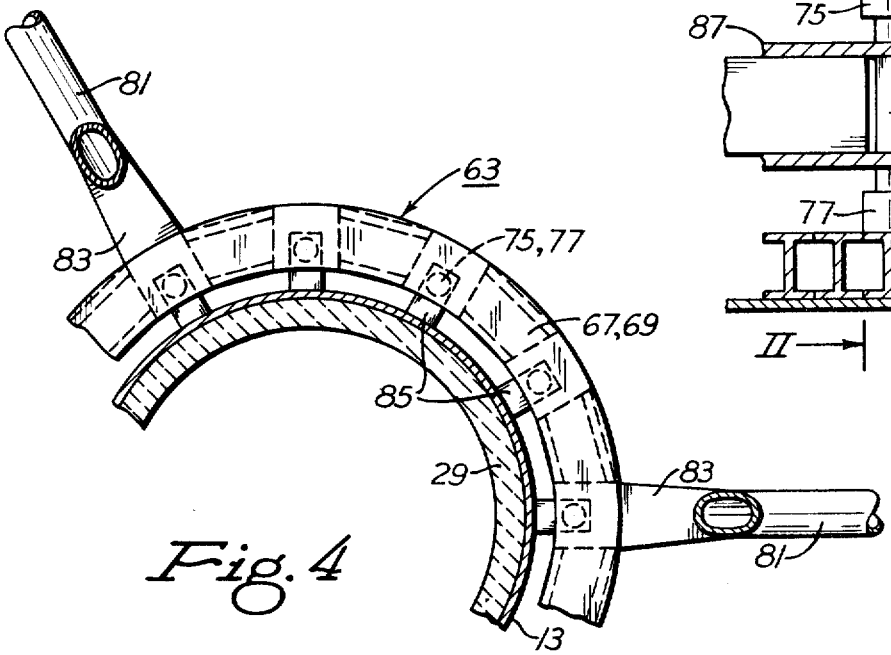
FIG. 4 is a view along line IV—IV of FIG. 2 showing one quadrant of the structure of FIG. 1.
Figure 3:
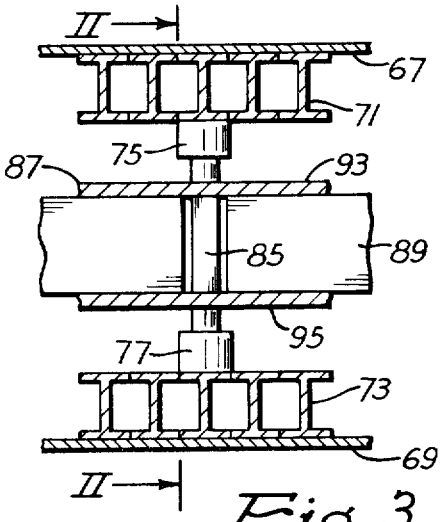
FIG. 3 is a view along line III—III of FIG. 2.

Another facet of the invention is the structure 63 provided near the top portion of the shell 13 that supports the upper shell and the top loading device 65. The structure 63 is shown in detail in FIGS. 2–4 and it comprises an annular top 67 and bottom 69 plates that surround the shell 13 in spaced-apart relation, as shown in FIGS. 2–4. The top 67 and bottom 69 plates are spaced apart vertically by intermediary structure disposed at spaced angular intervals around the perimeter of the annular plates 65, 67, as shown in FIG. 4.

Such intermediary structure includes a plurality of H-beams 71 secured suitably to the underneath surface of the top plate 67, and a similar plurality of H-beams 73 secured suitably to the upper surface of the lower plate 69. These H-beams carry upper 75 and lower 77 fluid-actuated piston-cylinder assemblies, disposed about as and where shown in FIGS. 2–4. The H-beams 71, 73 are connected together at their outer extremities by vertical H-beams 79 or the like.

Extending outwardly from the structure 63, at each one of only three locations, along the axes of supporting tubular legs 81, that are substantially the legs 37 shown in the aforementioned patent, is a massive plate bracket structure 83 that is secured suitably as by welding to the structure 63 and the tubular leg 81. These bracket structures 83 transfer the load carried by the structure 63 into the tubular legs 81 which, in turn, are supported upon suitable foundations or the ground.

Extending outwardly from the shell 13 at angularly spaced-apart intervals, as shown in FIG. 4, are vertical plates 85 that are suitably connected, as by welding, to the shell, and that coact with an annular box beam 87 that surrounds the shell 13 in spaced-apart relation about as shown in FIGS. 1 and 2. The box beam 87 is provided with openings in the vertical wall 91 adjacent the shell 13 through which openings extend the vertical plates 85. The vertical plates 85 coact with either the top or the bottom 93, 95 horizontal annular plates of the box 87, depending upon which direction the force of piston assemblies 75, 77 are applied to affect the size of perimetrical throat 37.

Within the box beam 87, between the vertical plates 85, are intercostal webs 89 that are secured suitably, as by welding, to the top 93 and bottom 95 horizontal annular plates.

The piston assemblies 75, 77 coact with the top and bottom plates 93, 95 of the box beam as shown in FIG. 2.

Those skilled in the art will recognize that at about level B—B of FIG. 1, the shell structure 13 includes a conventional expansion joint 96, like that shown in the aforementioned patent, that admits of vertical movement of the upper portion of the shell 13 in relation to the fixed lower portion of the shell 15.

The several fluid-actuated piston-cylinder assemblies, though not shown, are interconnected to a common fluid supply conduit whereby all of the upper assemblies 75 act in unison and all of the lower assemblies 77 act in unison also.

Those skilled in the art will recognize then that by actuating the several piston-cylinder assemblies simultaneously, the movable upper shell or envelope is movable vertically so that the cross-sectional area of the passageway or throat 37 through which blast air enters the furnace is adjustable.

Figure 6:
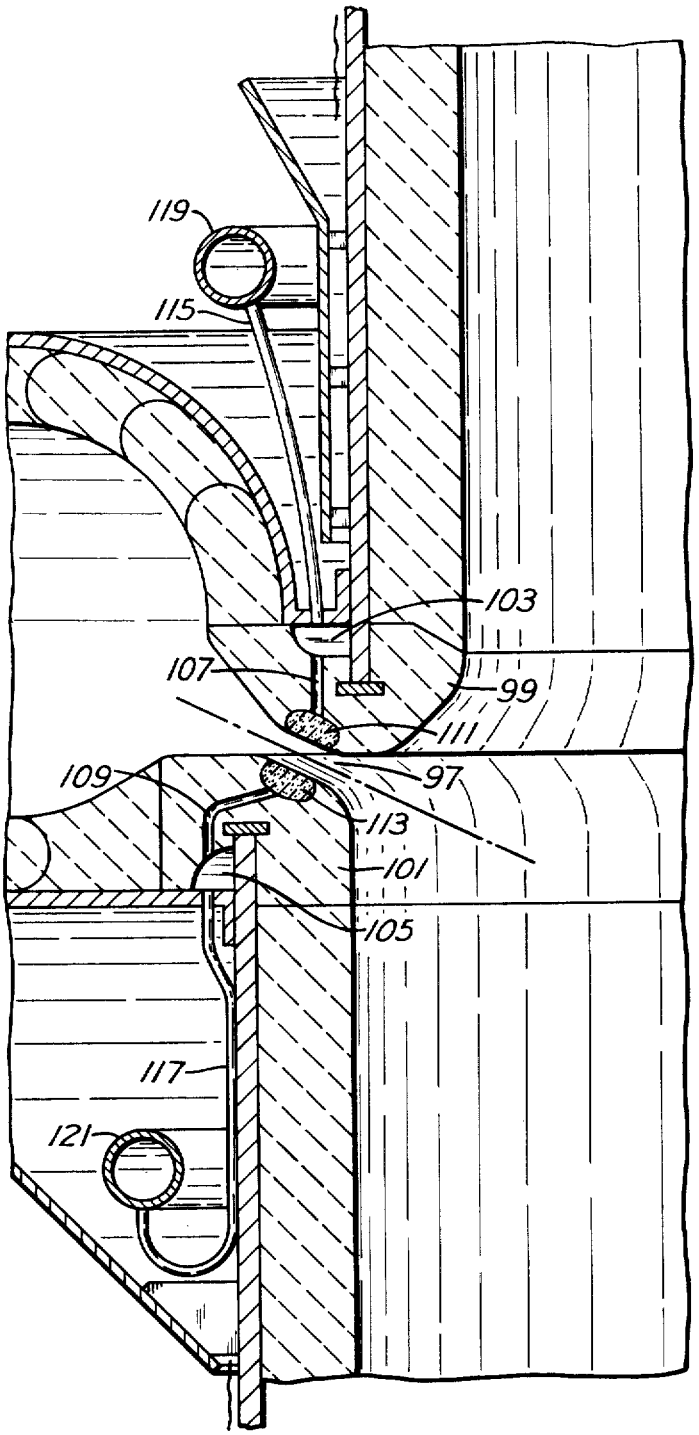
FIG. 6 is a partial view of structure like that of FIG. 5, but showing a modification thereof.

FIG. 6 illustrates another tuyere structure that is similar in many respects to the structure shown in FIG. 5. Since there is considerable similarity between the structure of FIG. 5 and that of FIG. 6, only the differences will be described hereinafter.

In FIG. 6, a tuyere throat 97 is formed by an upper refractory shape 99 and by a lower refractory shape 101. As mentioned previously, these special refractory shapes may be of zirconium oxide ($ZrO_2$) or any other suitable refractory material that will be as durable and as reliable. Each shape 99, 101 has a respective fluid annulus 103, 105 and these annuli extend around the perimeter of the furnace shell.

Each refractory shape 99, 101 has in its ends a groove, so that the grooves in the ends of abutting shapes 99, 101 form respective vertical fluid passages 107, 109 leading from the respective fluid annuli to porous refractory inserts 111, 113 that are set into the respective refractory shapes 99, 101. The porous inserts 111, 113 are of finite length and are spaced apart around the length of the respective refractory shapes 99, 101.

Each fluid annulus 103, 105 is connected to a respective fluid conduit 115, 117 which carry fluid from respective fluid headers 119, 121 that encircle the shell about as and where shown in FIG. 6.

In operating the blast furnace 11, fluid can be forced into the headers 119, 121 from which it flows through the conduits 115, 117 into the fluid annuli 103, 105. Thence, the fluid flows in the conduit-like matching grooves 107, 109 to the porous refractory inserts 111, 113 to keep them cool, and also to keep the refractory shapes 99, 101 relatively cooler than they would otherwise be without the inserts, and to supply fuel to the combustion process.

From the foregoing description of one embodiment of the invention and a modification thereof, those skilled in the art should recognize many important features and advantages of the invention, among which the following are particularly significant:

That in comparison with a conventional blast furnace the structure of the blast furnace of the present invention is significantly improved. In a conventional blast furnace having a hearth diameter of some 45 feet, there may be as many as 40 tuyeres, each being 7 inches in diameter, accounting for a total tuyere area of about 1540 square inches of blast area. To equal this area in the blast furnace of the present invention, having a continuous perimetrical throat 37, it would have to be only 0.9 inches in height. Changing this height or cross-sectional area, by means of the fluid-acting piston-cylinder arrangements 75, 77, by a very small amount changes the total throat area for discharge of blast air very significantly. Thus, in the blast furnace of the present invention, the area for discharge of blast air is variable, which is not possible with conventional tuyeres in conventional blast furnaces;

That, because there are no conventional type of water-cooled tuyeres in the blast furnace of the present invention, no pressurized cooling members are present that could leak water into the furnace and thereby halt production;

That, because there are no conventional water-cooled tuyeres in the blast furnace of the present invention, there will be no lost production time that is spent in changing tuyeres in conventional furnaces;

That, because the perimetrical tuyere or throat of the present blast furnace invention is variable, the penetration of the blast from the tuyere throat around the periphery of the furnace can be altered at will, and can be made equivalent in area to any given number of tuyeres of any given diameter rather than be limited to a fixed number of tuyeres predetermined by external geometry and structural considerations of the furnace, with the effect of an additional control over production in the furnace;

That, should it become necessary or desirable at any time to inject oil fuel into the tuyere zone of the furnace, this can be accomplished readily by inserting fuel-injection nozzles into the tuyere belt or plenum through the peepsight holes after the peepsights have been removed or, by resorting to such alternative construction as is shown in FIG. 6, fuel gases may be injected through porous inserts.

Although the invention has been described herein with a certain degree of particularity it is understood that the present disclosure has been made only as an example and that the scope of the invention is defined by what is hereinafter claimed.

What is claimed is:

1. A metallurgical furnace for producing molten metal from ore, wherein the improvement comprises:

a. a refractory shell having an upper portion spaced apart from a lower portion;

b. a refractory-lined conduit connected to and surrounding both said upper and said lower shell portions, said conduit having a continuous opening therein in communication with the space between said upper and lower portions and with c. said refractory lining forming a venturi throat between said upper and lower portions;

d. means for moving said upper portion with respect to said lower portion to thereby vary the cross section of said venturi throat; and e. means for distributing blast air in said conduit so that it flows into said furnace.

2. The invention of claim 1 wherein:

a. said blast air passing through said venturi throat is directed angularly downward into said furnace.

3. The invention of claim 1 wherein:

a. said means for varying the cross-sectional area of said passageway includes fluid-actuated means for urging said upper portion to move relative to said lower portion.

4. The invention of claim 3 including:

a. means for cooling said blast air distributing conduit.

5. The invention of claim 1 wherein:

a. said refractory lining of said conduit includes shapes that form said venturi throat.

6. The invention of claim 1 wherein:

a. said lower fixed portion has a larger diameter than said upper movable portion.

7. The invention of claim 1 including:

a. a plurality of inspection openings in said conduit.

8. A metallurgical furnace for producing molten metal from ore, wherein the improvement comprises:

a. a refractory-lined envelope that includes a lower fixed portion and an upper movable portion spaced apart from said lower portion, the space between said lower and said upper portions constituting a circumferential passageway through said envelope;

b. means for supporting and moving said upper movable portion of said envelope relative to said lower fixed portion; and c. a conduit encircling said envelope and having a continuous opening therein in communication with said space, said conduit serving as a carrier of blast air that enters said furnace through said space defined by refractory material so formed as to create a venturi throat.

9. The invention of claim 8 including:

a. a plurality of inspection openings in said conduit.

10. The invention of claim 8 wherein:

a. said lower fixed portion of said envelope has a larger diameter than said upper movable portion whereby said passageway is directed downward with respect to a horizontal plane through said conduit.

11. The invention of claim 8 wherein:

a. said means for moving said upper envelope portion includes fluid-actuated cylinder-piston assemblies secured to i. said upper portion and to ii. fixed structure adjacent said envelope.

12. The invention of claim 8 wherein:

a. the refractory material of said throat has means whereby a fluid may be dispersed through porous portions thereof to act as a coolant for the adjacent refractory.

13. The invention of claim 8 wherein:

a. said refractory material of said throat has porous portions through which a fluid passes as a source of heat for said process.

* * * * *